US006697023B1

(12) United States Patent
Tiao-Hsing et al.

(10) Patent No.: US 6,697,023 B1
(45) Date of Patent: Feb. 24, 2004

(54) BUILT-IN MULTI-BAND MOBILE PHONE ANTENNA WITH MEANDERING CONDUCTIVE PORTIONS

(75) Inventors: Tsai Tiao-Hsing, Taipei (TW); Huang-Tse Peng, Taipei Hsien (TW); Kai Shih, Taipei (TW)

(73) Assignee: Quanta Computer Inc., Tao-Yuan Hsien (TW)

( * ) Notice: Subject to any disclaimer, the term of this patent is extended or adjusted under 35 U.S.C. 154(b) by 0 days.

(21) Appl. No.: 10/274,915

(22) Filed: Oct. 22, 2002

(51) Int. Cl.[7] ..... H01Q 1/24
(52) U.S. Cl. ..... 343/702; 343/700 MS
(58) Field of Search ..... 343/702, 700 MS, 343/833, 834, 725, 727; H01Q 1/24

(56) References Cited

U.S. PATENT DOCUMENTS 6,285,342 B1 * 9/2001 Brady et al. ..... 343/895
6,337,667 B1 * 1/2002 Ayala et al. ..... 343/795
6,489,925 B2 * 12/2002 Thursby et al. ..... 343/700 MS
6,529,170 B1 * 3/2003 Nishizawa et al. ..... 343/795

* cited by examiner

*Primary Examiner*—Hoanganh Le
(74) *Attorney, Agent, or Firm*—Finnegan, Henderson, Farabow, Garrett & Dunner, L.L.P.

(57) ABSTRACT

A built-in multi-band mobile phone antenna includes: a meandering conductive body having a signal feeding point, and first and second meandering conductive portions disposed at two sides of the signal feeding point; a conductive flat first radiating plate in electrical connection with the first meandering conductive portion and tuned to a low frequency range; an elongated conductive flat second radiating plate in electrical connection with the second meandering conductive portion and a grounding point and tuned to a high frequency range; and a conductive flat parasitic plate in electrical connection with the grounding point so as to widen the bandwidth of the antenna. The conductive body, the first and second radiating plates, and the parasitic plate define cooperatively a plate-shaped accommodating space thereamong for receiving a plate-shaped electronic element.

12 Claims, 3 Drawing Sheets

BUILT-IN MULTI-BAND MOBILE PHONE ANTENNA WITH MEANDERING CONDUCTIVE PORTIONS

BACKGROUNDING OF THE INVENTION

1. Field of the Invention

This invention relates to multi-band antenna, and more particularly to a built-in multi-band mobile phone antenna.

2. Description of the Related Art

Advancements in electronic communication technology have led to a reduction in the overall sizes of mobile phones, personal digital assistants (PDA), and the like. Built-in type mobile phone antennas are attractive accordingly, and include planar inverted F antennas (PIFA), microstrip antennas, etc.

Referring to FIG. 1, a conventional PIFA 5 is shown to include a conductive flat radiating plate 51 that defines a gap 52 and that has a first plate portion 511, a second plate portion 512, a signal feeding point (F) that is disposed between the first and second plate portions 511, 512, and a grounding point (G) that is adjacent to the signal feeding point (F). The radiating plate 51 is connected electrically to a coaxial cable 54 at the signal feeding point (F), and to a grounding plate 6 at the grounding point (G) via a conductive grounding leg 55. Four dielectric legs 56 are fixed on the grounding plate 6 for supporting four corners of the radiating plate 51. The conventional PIFA can operate in a 900 MHZ frequency band and a 1900 MHZ frequency band so that the bandwidth of the PIFA is relatively narrow, thereby resulting in poor signal communications. A parasitic element 7 (see FIG. 2) can be added to the PIFA so as to widen the bandwidth of the 1800 MHZ frequency band, thereby facilitating the signal communications. However, the bandwidth of the 900 MHZ frequency band still cannot be widened.

SUMMARY OF THE INVENTION

The object of this invention is to provide a compact built-in multi-band mobile phone antenna, which can overcome the drawbacks associated with the prior art.

According to this invention, a built-in multi-band mobile phone antenna includes: a meandering conductive body having a signal feeding point, and first and second meandering conductive portions disposed at two sides of the signal feedingpoint; a conductive flat first radiating plate in electrical connection with the first meandering conductive portion and tuned to a low frequency range; an elongated conductive flat second radiating plate in electrical connection with the second meandering conductive portion and a grounding point and tuned to a high frequency range; and a conductive flat parasitic plate in electrical connection with the grounding point so as to widen the bandwidth of the antenna. The conductive body, the first and second radiating plates, and the parasitic plate define cooperatively a plate-shaped accommodating space thereamong for receiving a plate-shaped electronic element, e.g. a printed circuit board.

The low frequency range includes a 900 MHZ frequency band corresponding to a GSM frequency band, the bandwidth of which is widened by the parasitic plate. The high frequency range includes a 1800 MHZ frequency band corresponding to a DCS frequency band, and a 1900 MHZ frequency band corresponding to a PCS frequency band because the first and second meandering conductive portions can widen the bandwidth of the 1800 MHZ frequency band so as to transmit and receive a 1900 MHZ frequency signal.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Before the present invention is described in greater detail in connection with the preferred embodiments, it should be noted that similar elements and structures are designated by like reference numbers throughout the entire disclosure.

Figure 1:
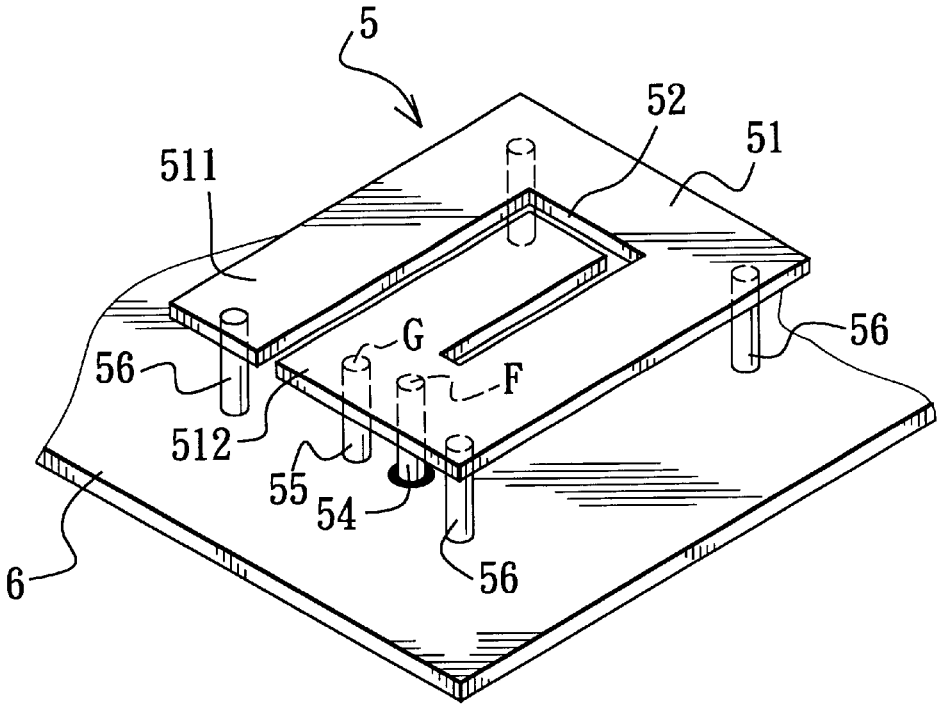
F I G. 1 PRIOR ART
FIG. 1 is a fragmentary perspective view of a conventional PIFA.
Figure 2:
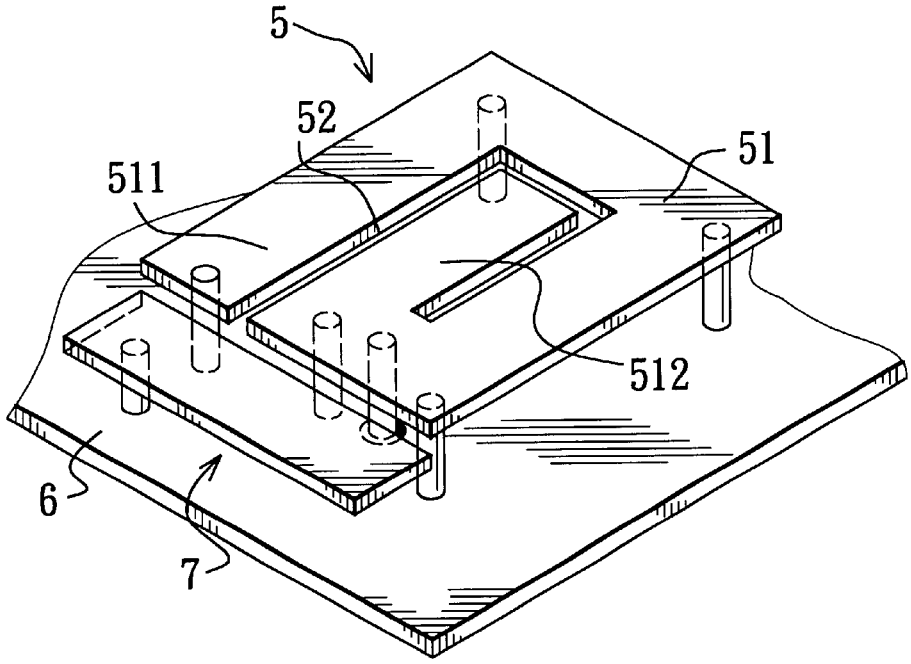
FIG. 2 is a fragmentary perspective view of another conventional PIFA modified from that of FIG. 1 by adding a parasitic element.
Figure 3:
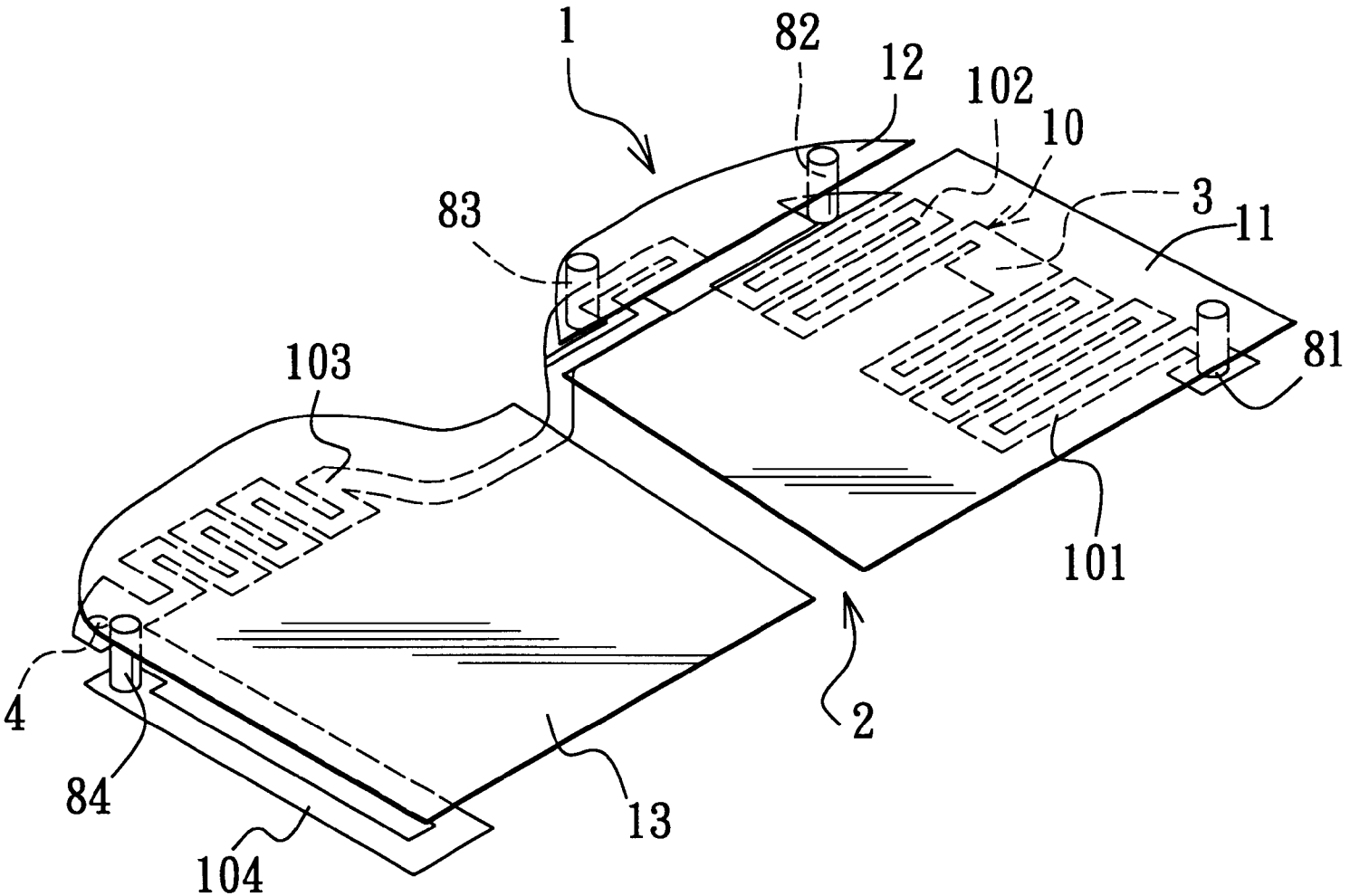
FIG. 3 is a perspective view of a first preferred embodiment of a built-in multi-band mobile phone antenna according to this invention.

Referring to FIG. 3, a first preferred embodiment of a built-in multi-band mobile phone antenna 1 according to this invention is shown to include a meandering conductive body 10, a conductive flat first radiating plate 11, and an elongated conductive flat second radiating plate 12, and a conductive flat parasitic plate 13.

The conductive body 10 has a first meandering conductive portion 101, a second meandering conductive portion 102, and a signal feeding point 3 disposed between the first and second meandering conductive portions 101, 102.

The first radiating plate 11 is spaced apart from the conductive body 10, is connected electrically to the first meandering conductive portion 101 of the conductive body 10 via a conductive coupling leg 81, and is tuned to a low frequency range, which includes a 900 MHZ frequency band corresponding to a GSM frequency band.

The second radiating plate 12 is spaced apart from the conductive body 10, is connected electrically to the second meandering conductive portion 102 via a conductive coupling leg 82 at one end and to a grounding point 4 via a conductive coupling leg 83 and a third meandering conductive portion 103 at the other end, and is tuned to a high frequency range, which includes a 1800 MHZ frequency band corresponding to a DCS frequency band, and a 1900 MHZ frequency band corresponding to a PCS frequency band. Note that the second and third meandering conductive portions 102, 103 and the second radiating plate 12 constitute a loop antenna, and can lead to an increase in the bandwidth of the 1800 MHZ frequency band so as to transmit and receive a 1900 MHZ frequency signal.

The parasitic plate 13 is connected electrically to the grounding point 4 via a conductive coupling leg 84 and a fourth meandering conductive portion 104, and serves to widen the bandwidth of the 900 MHZ frequency band.

The first, second, third, and fourth meandering conductive portions 101, 102, 103, 104 are coplanar, and the parasitic plate 13 is coplanar with the first and second radiating plates 11, 12 so as to define a plate-shaped accommodating space 2 thereamong for receiving a plate-shaped electronic element (not shown).

Figure 4:
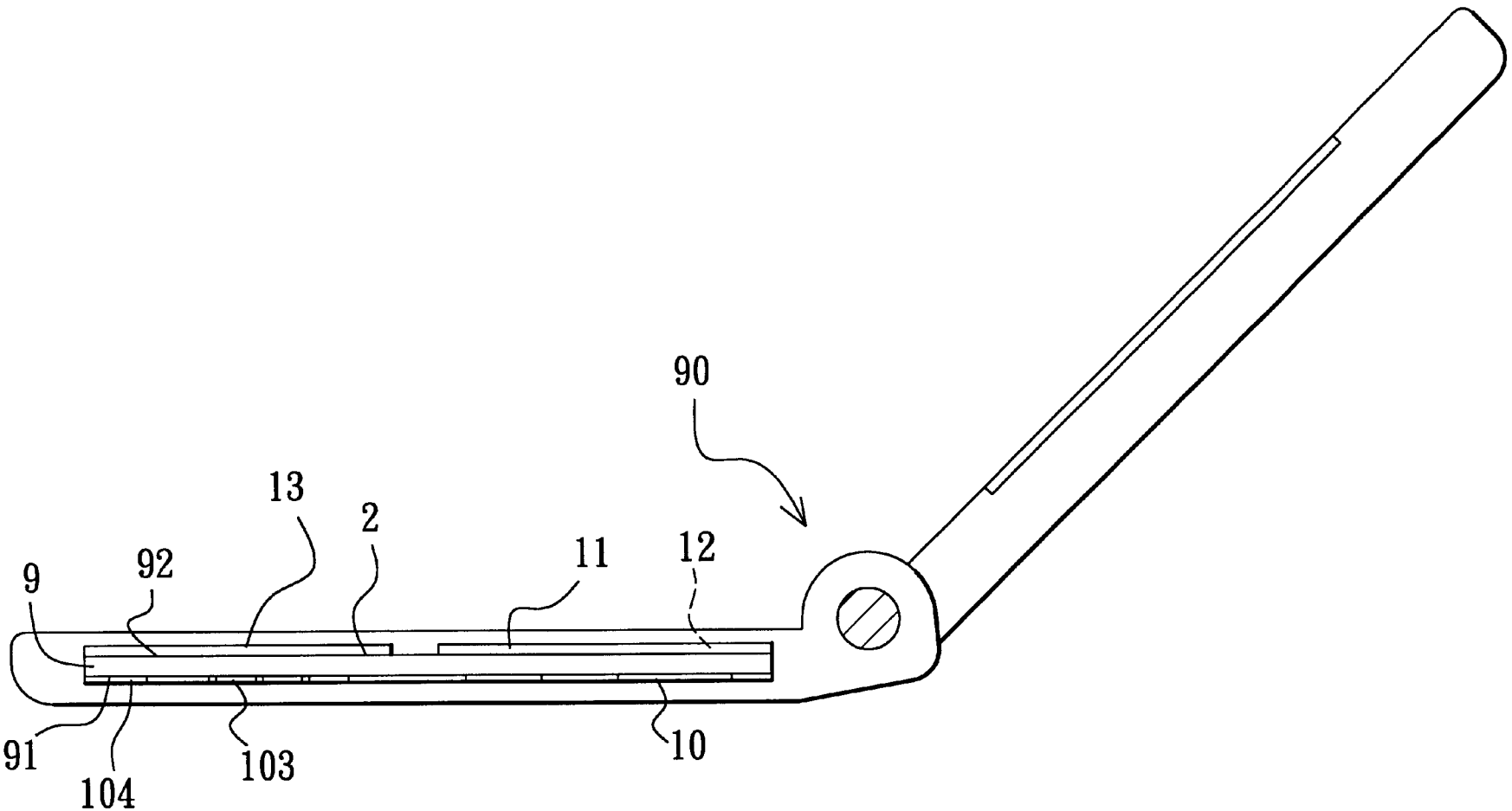
FIG. 4 is a side view of a second preferred embodiment of a built-in multi-band mobile phone antenna according to this invention, which is incorporated into a mobile phone.

FIG. 4 shows a second preferred embodiment of this invention, which is incorporated into a mobile phone 90 and which is similar to the first preferred embodiment in construction. In this embodiment, a printed circuit board 9 is fixed within the accommodating space 2. The board 9 has first and second side surfaces 91, 92. The conductive body 10, and the third and the fourth meandering conductive portions 103, 104 are disposed on the first side surface 91 of the board 9. The first and second radiating plates 11, 12, and the parasitic plate 13 are disposed on the second side surface 92 of the board 9. In this embodiment, the coupling legs 81, 82, 83, 84 (see FIG. 3) are replaced with four metallic diaphragms (not shown), which extend through holes (not shown) in the board 9. As such, both the antenna of this invention and a radio frequency circuit (not shown) for controlling transmission and reception of an electromagnetic wave can be installed on the printed circuit board 9. As such, it is possible to mass-produce the mobile phones 90 with relative ease.

With this invention thus explained, it is apparent that numerous modifications and variations can be made without departing from the scope and spirit of this invention. It is therefore intended that this invention be limited only as indicated by the appended claims.

We claim:

1. A built-in multi-band mobile phone antenna comprising:

a meandering conductive body having a first meandering conductive portion, a second meandering conductive portion, and a signal feeding point disposed between said first and second meandering conductive portions;

a conductive flat first radiating plate spaced apart from said conductive body, said first radiating plate being in electrical connection with said first meandering conductive portion of said conductive body and tuned to a low frequency range;

an elongated conductive flat second radiating plate spaced apart from said conductive body, said second radiating plate being in electrical connection with said second meandering conductive portion of said conductive body at one end and being adapted to be connected electrically to a grounding point at the other end, said second radiating plate being tuned to a high frequency range that is different from said low frequency range; and a conductive flat parasitic plate adapted to be in electrical connection with the grounding point so as to widen bandwidth of said antenna, all of said conductive body, said first and second radiating plates, and said parasitic plate defining cooperatively a plate-shaped accommodating space thereamong.

2. The built-in multi-band mobile phone antenna as claimed in claim 1, further comprising a third meandering conductive portion that is in electrical connection with said second radiating plate and that is adapted to be in electrical connection with the grounding point.

3. The built-in multi-band mobile phone antenna as claimed in claim 2, further comprising a fourth meandering conductive portion that is in electrical connection with said parasitic plate and that is adapted to be in electrical connection with the grounding point.

4. The built-in multi-band mobile phone antenna as claimed in claim 3, wherein said first, second, third, and fourth meandering conductive portions are coplanar, and said parasitic plate is coplanar with said first and second radiating plates.

5. The built-in multi-band mobile phone antenna as claimed in claim 1, wherein said low frequency range includes a 900 MHZ frequency band corresponding to a GSM frequency band.

6. The built-in multi-band mobile phone antenna as claimed in claim 1, wherein said high frequency range includes a 1800 MHZ frequency band corresponding to a DCS frequency band, and a 1900 MHZ frequency band corresponding to a PCS frequency band.

7. The built-in multi-band mobile phone antenna as claimed in claim 1, further comprising a printed circuit board that is fixed within said accommodating space.

8. The built-in multi-band mobile phone antenna as claimed in claim 7, wherein said printed circuit board has first and second side surfaces that are opposite to each other, said conductive body being disposed on said first side surface of said printed circuit board, said first and second radiating plates and said parasitic plate being disposed on said second side surface of said printed circuit board.

9. The built-in multi-band mobile phone antenna as claimed in claim 8, further comprising a third meandering conductive portion, which is disposed on said first side surface of said printed circuit board, which is in electrical connection with said second radiating plate, and which is adapted to be in electrical connection with the grounding point.

10. The built-in multi-band mobile phone antenna as claimed in claim 9, further comprising a fourth meandering conductive portion, which is disposed on said first side surface of said printed circuit board, which is in electrical connection with said parasitic plate, and which is adapted to be in electrical connection with the grounding point.

11. The built-in multi-band mobile phone antenna as claimed in claim 10, wherein said low frequency range includes a 900 MHZ frequency band corresponding to a GSM frequency band.

12. The built-in multi-band mobile phone antenna as claimed in claim 11, wherein said high frequency range includes a 1800 MHZ frequency band corresponding to a DCS frequency band, and a 1900 MHZ frequency band corresponding to a PCS frequency band.

* * * * *